US005832791A

United States Patent [19]

Lin

[11] Patent Number: 5,832,791

[45] Date of Patent: Nov. 10, 1998

[54] TOOL HANDLE ASSEMBLY

[76] Inventor: Ching Chou Lin, No. 150, Sec. 3, Chun San Road, Wu Zh Hsiang, Taichung Hsien, Taiwan

[21] Appl. No.: 748,823

[22] Filed: Nov. 14, 1996

[51] Int. Cl.[6] ..... B25B 13/46

[52] U.S. Cl. ..... 81/62; 81/177.1; 81/489; 81/492

[58] Field of Search ..... 81/52, 58, 58.3, 81/58.4, 59.1, 60–63.2, 437–439, 177.1, 29–33, 489, 492

[56] References Cited

U.S. PATENT DOCUMENTS

| | | | |
|---|---|---|---|
| 1,438,227 | 12/1922 | Eisenhard | 81/29 |
| 1,878,053 | 9/1932 | Winger | 81/29 X |
| 3,823,624 | 7/1974 | Martin | 81/29 X |
| 4,341,292 | 7/1982 | Acevedo | 81/31 X |
| 4,597,478 | 7/1986 | Bodnar | 81/62 X |
| 4,621,718 | 11/1986 | DeCarlos | 81/63.1 X |
| 4,777,852 | 10/1988 | Herman et al. | 81/63.1 |
| 5,201,255 | 4/1993 | Gegg | 81/62 X |
| 5,427,003 | 6/1995 | Boltak et al. | 81/58.3 |
| 5,520,073 | 5/1996 | Bakula et al. | 81/63.2 X |

*Primary Examiner*—D. S. Meislin
*Attorney, Agent, or Firm*—Charles E. Baxley, Esq.

[57] ABSTRACT

A tool handle assembly includes a barrel having a bore and a cap having a hole. An element has a front tube for engaging through the bore of the barrel and has a rear protrusion for engaging in the hole of the cap. The tube includes an annular rib for engaging with and for rotatably supporting the barrel on the tube, and for allowing the barrel and the element and the cap to be assembled together without additional tool. The element includes a curved upper and bottom portions for allowing the user to grasp comfortably.

5 Claims, 5 Drawing Sheets

TOOL HANDLE ASSEMBLY

BACKGROUND OF THE INVENTION

1. Field of the Invention

The present invention relates to a handle, and more particularly to a tool handle assembly.

2. Description of the Prior Art

Typical tool handles, particularly the ratchet screw driver handles comprise a cylindrical body for engaging with the hand of the user. However, the ratchet screw driver handles comprise a number of elements that are required to be assembled together by other tools. In addition, the tool handle normally includes a cylindrical shape. The hand of the user may feel hurt when using such a tool handle.

The present invention has arisen to mitigate and/or obviate the afore-described disadvantages of the conventional tool handles.

SUMMARY OF THE INVENTION

The primary objective of the present invention is to provide a tool handle assembly which may be easily assembled without additional tools.

The other objective of the present invention is to provide a tool handle assembly which may allow the user to grasp the tool handle comfortably.

In accordance with one aspect of the invention, there is provided a tool handle assembly comprising a barrel including a bore and including a front portion and including a rear portion, a cap including a hole formed therein, a body including a front portion having a tube extended forward and extended through the bore of the barrel, the body including a rear portion having a protrusion formed thereon for engaging in the hole of the cap, and means for securing the barrel to the body and for allowing the barrel and the body and the cap to be assembled together without additional tool.

The barrel includes an annular shoulder and a notch formed in the rear portion, the body includes an annular bulge formed in the front portion for engaging with the annular shoulder of the barrel and includes a key for engaging with the notch of the barrel and for preventing the barrel from rotating relative to the body.

The cap includes a pair of lumps formed therein, the protrusion of the body includes two depressions for engaging with the lumps of the cap and for allowing the cap to be solidly secured to the body.

The body includes a curved upper portion for engaging with a palm of a user and includes a curved bottom portion for engaging with fingers of the user, and includes a recess for engaging with a ring finger of the user.

The body includes a chamber formed therein and includes two pairs of channels formed therein, the body further includes two partitions secured in the channels, a stem rotatably engaged in the partitions, at least one gear secured on the stem and located between the partitions, a pair of pawls engaged in the body for engaging with the gear, and a knob having an actuator for engaging with the pawls for controlling an engagement of the pawls with the gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
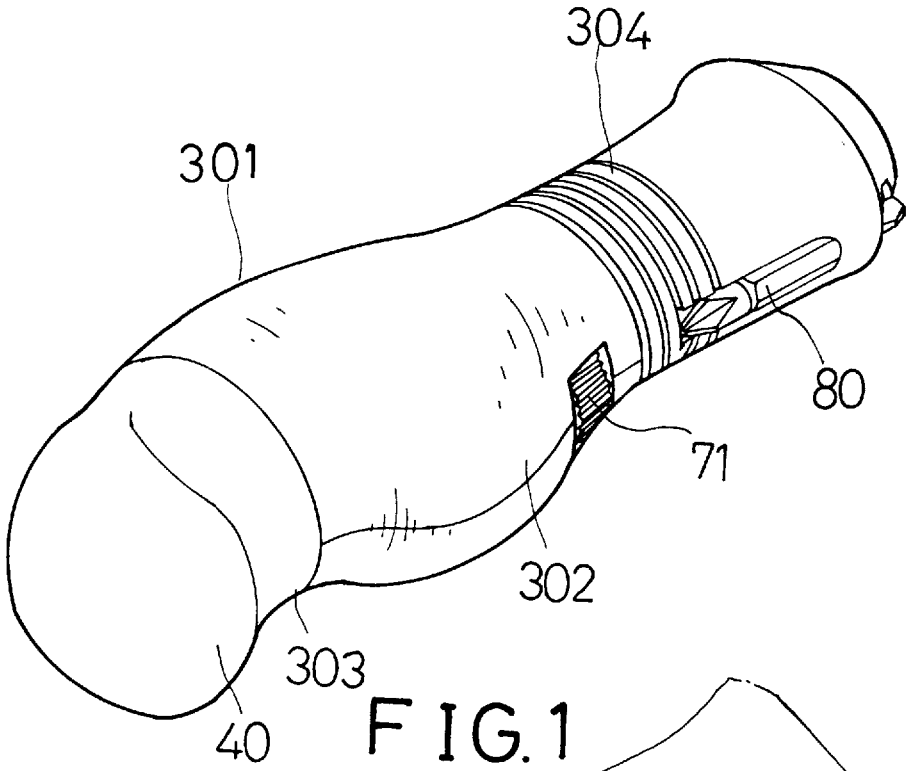
FIG. 1 is a perspective view of a tool handle assembly in accordance with the present invention.
Figure 2:
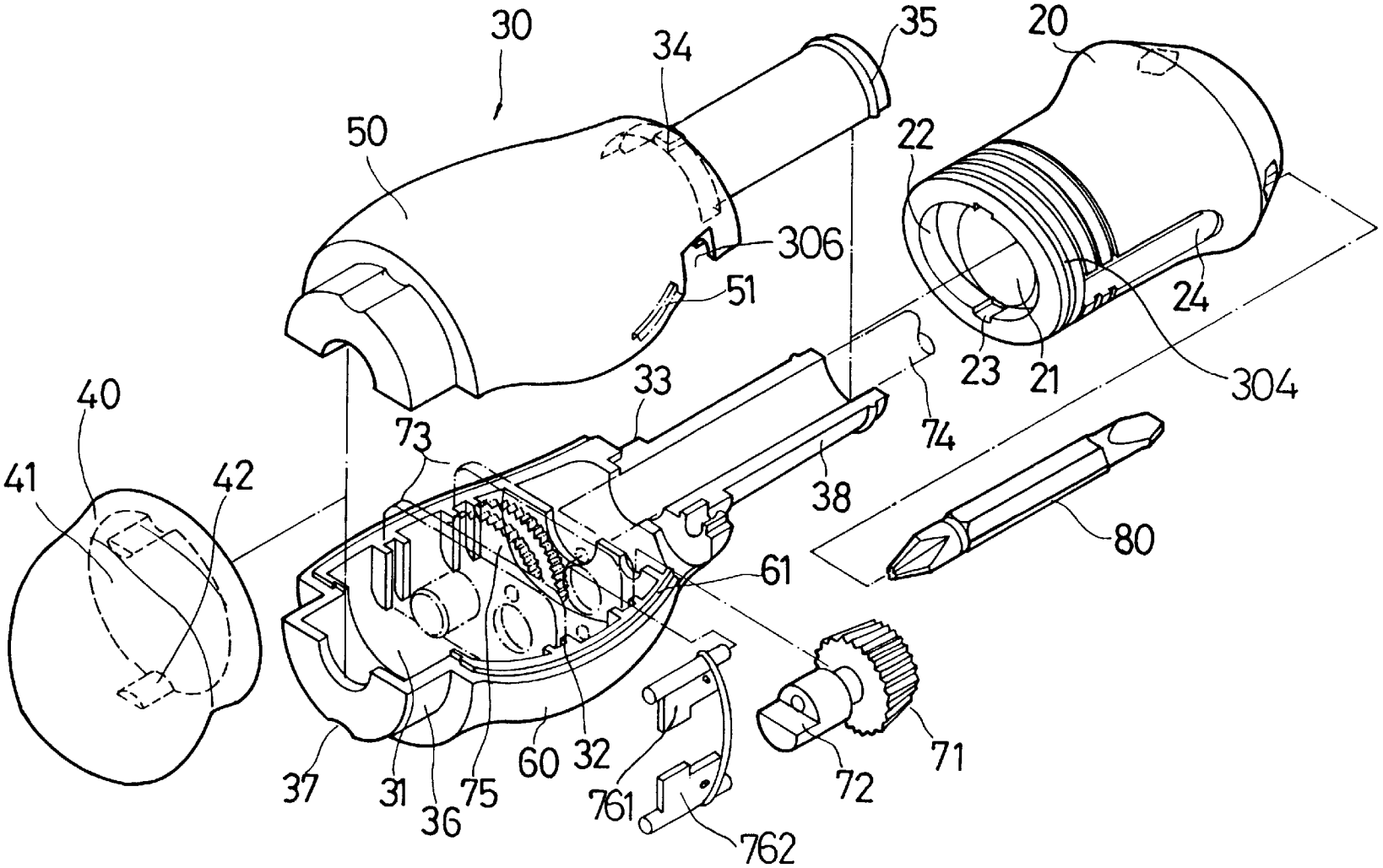
FIG. 2 is an exploded view of the tool handle assembly.

Referring to the drawings, and initially to FIGS. 1 and 2, a tool handle assembly in accordance with the present invention comprises a barrel 20 including a bore 21 and including a rear portion having an annular shoulder 22 and having a notch 23 formed therein. The barrel 20 includes a number of annular grooves 304 for facilitating the grasp of the tool handle assembly. The barrel 20 includes one or more openings 24 formed therein for engaging with tool bits 80.

A body 30 includes two members 50, 60 secured together by projections 51 and slots 61. The body 30 includes a tube 38 extended forward for engaging through the bore 21 of the barrel 20. The tube 38 includes an annular rib 35 formed in the front portion for engaging with the barrel 20 by such as force-fitted engagement and for rotatably securing the barrel 20 on the tube 38. The body 30 includes an annular bulge 33 for engaging with the annular shoulder 22 of the barrel 20 and includes a key 34 for engaging with the notch 23 of the barrel 20 by such as force-fitted engagement and for preventing the barrel 20 from rotating relative to the body 30. The body 30 includes a protrusion 36 formed in the rear portion for engaging with the hole 41 of a cap 40 which includes two lumps 42 for engaging with the corresponding depressions 37 of the protrusion 36 by such as force-fitted engagement and for allowing the cap 40 to be secured to the protrusion 36 of the body 30. The barrel 20 and the members 50, 60 of the body 30 and the cap 40 may thus be assembled together without additional tools.

The body 30 includes a chamber 31 formed therein and includes two pairs of channels 32 formed therein for engaging with two partitions 73. A stem 74 is rotatably engaged in the partitions 73 and includes one or more gears 75 secured thereon. A pair of typical pawls 761, 762 are engaged in the body 30 for engaging with the gears 75 and for allowing the stem 74 to be moved in a ratchet way, i.e., the stem 74 may move in an active or a reverse direction or in both directions. A knob 71 is rotatably secured to the partitions 73 and includes an actuator 72 for engaging with the pawls 761, 762 and for controlling the engagement of the pawls 761, 762 with the gears 75. The knob 71 is engaged in an orifice 306 of the body 30 for allowing the knob 71 to be operated by the user.

Figure 4:
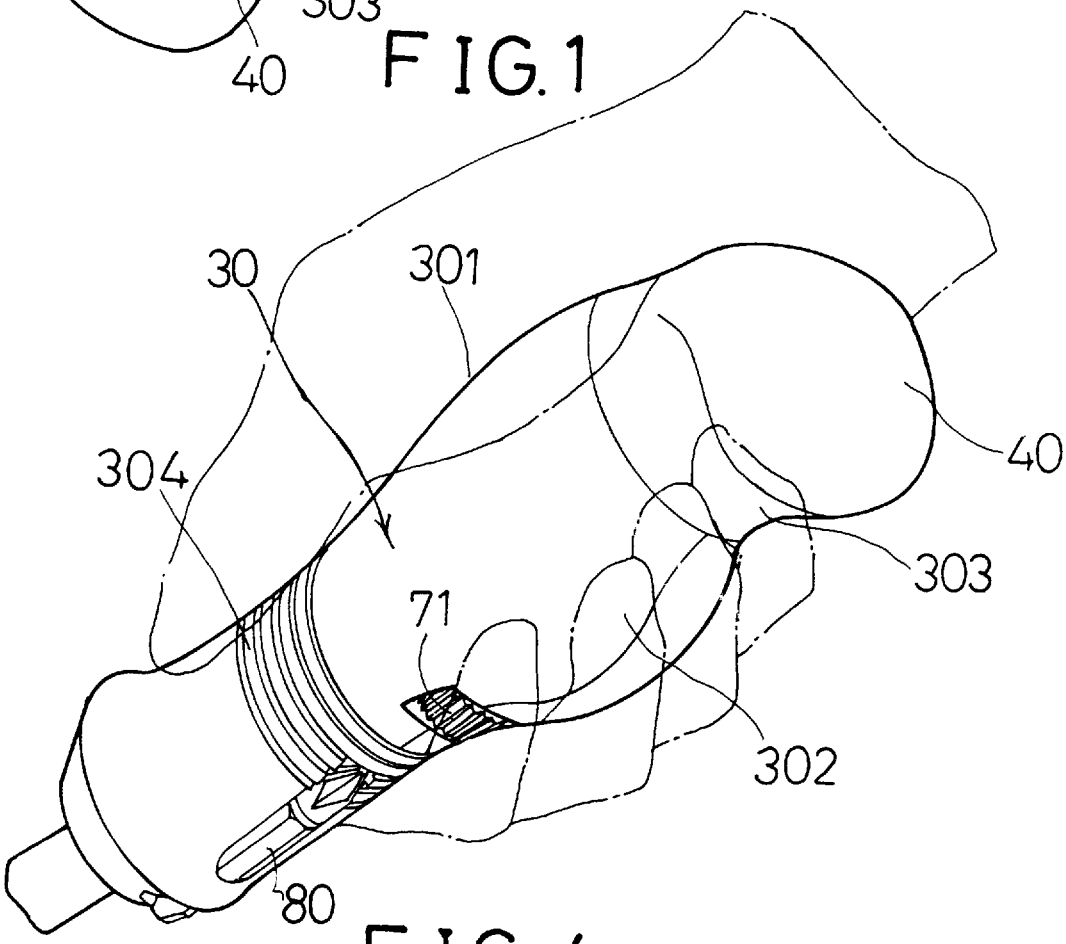
FIGS. 3 and 4 are perspective views illustrating the operation of the tool handle assembly.
Figure 3:
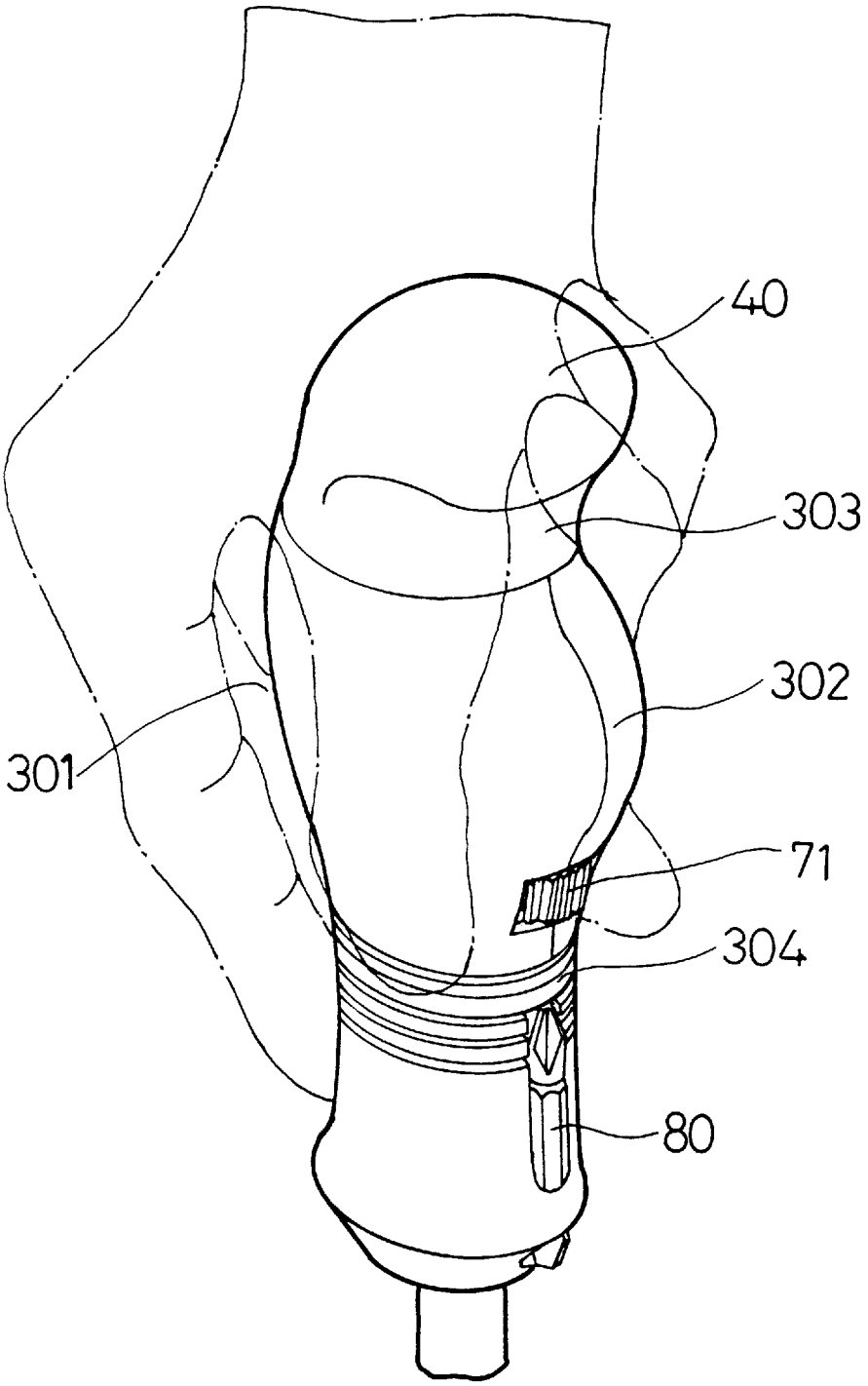
Figure 5:
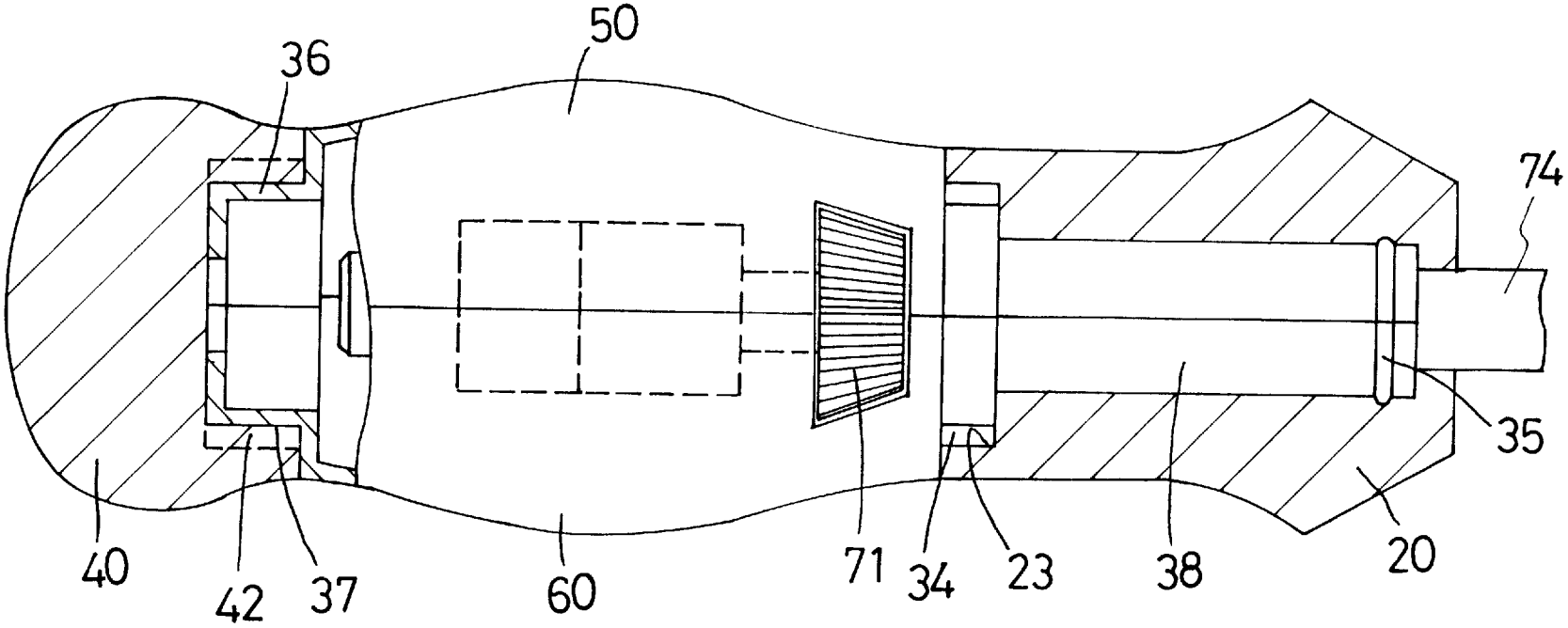
FIG. 5 is a partial cross section of the tool handle assembly.
Figure 6:
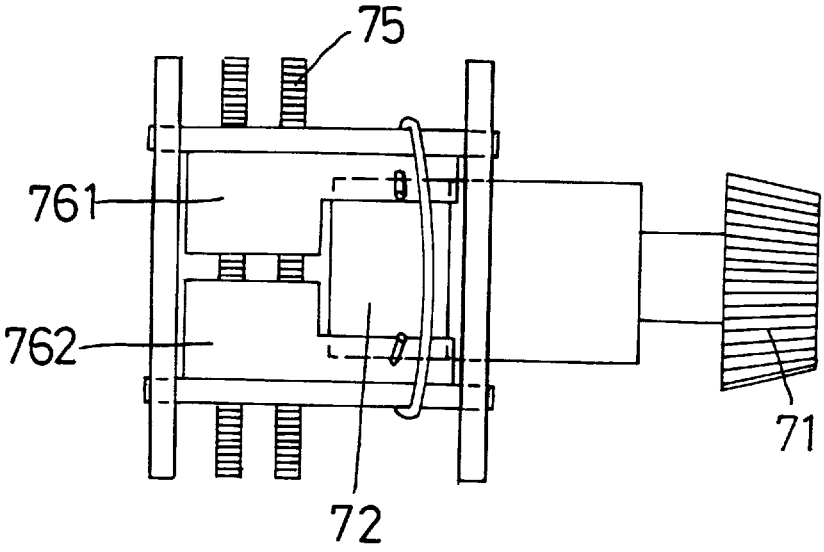
FIG. 6 is a partial plan view illustrating the structural cooperation between the ratchet elements.
Figure 7:
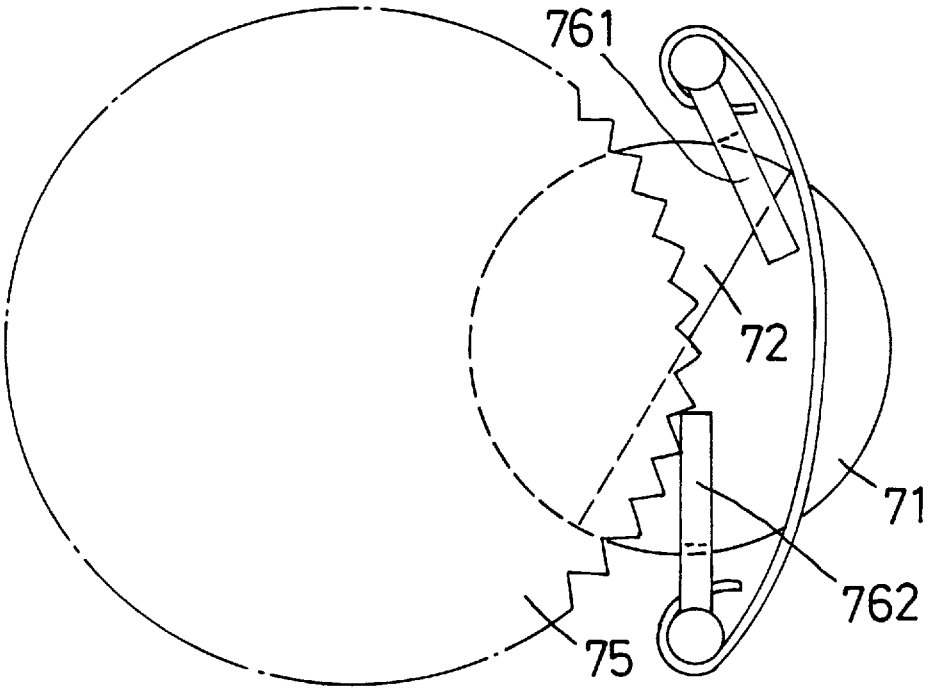
FIG. 7 is a schematic view illustrating the structural cooperation between the ratchet elements.

Referring next to FIGS. 3, 4 and again to FIG. 1 the tool handle assembly includes a curved upper portion 301 for engaging with the palm of the user, and includes a curved bottom portion 302 for engaging with the fingers of the user and includes a recess 303 for engaging with the ring finger such that the tool handle assembly may be grasped by the user comfortably.

Accordingly, the tool handle assembly in accordance with the present invention includes a number of members that may be easily assembled without additional tools. In addition, the tool handle assembly allows the user to grasp the tool handle comfortably.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle assembly comprising:

a barrel including a bore and including a front portion and including a rear portion, a cap including a hole formed therein, a body including a front portion having a tube extended forward and extended through said bore of said barrel, said body including a rear portion having a protrusion formed thereon for engaging in said hole of said cap, and said tube including a front portion, and means for securing said barrel to said body and for allowing said barrel and said body and said cap to be assembled together without additional tool, said barrel including an annular shoulder and a notch formed in said rear portion, said body including an annular bulge formed in said front portion for engaging with said annular shoulder of said barrel and including a key for engaging with said notch of said barrel and for preventing said barrel from rotating relative to said body.

2. The tool handle assembly according to claim 1, wherein said body includes a curved upper portion for engaging with a palm of a user and includes a curved bottom portion for engaging with fingers of the user, and includes a recess for engaging with a ring finger of the user.

3. The tool handle assembly according to claim 1, wherein said securing means includes an annular rib formed on said front portion of said tube for engaging with said barrel and for rotatably supporting said barrel on said tube.

4. A tool handle assembly comprising:

a barrel including a bore and including a front portion and including a rear portion, a cap including a hole formed therein, a body including a front portion having a tube extended forward and extended through said bore of said barrel, said body including a rear portion having a protrusion formed thereon for engaging in said hole of said cap, and said tube including a front portion, and means for securing said barrel to said body and for allowing said barrel and said body and said cap to be assembled together without additional tool, said cap including a pair of lumps formed therein, said protrusion of said body including two depressions for engaging with said lumps of said cap and for allowing said cap to be solidly secured to said body.

5. A tool handle assembly comprising:

a barrel including a bore and including a front portion and including a rear portion, a cap including a hole formed therein, a body including a front portion having a tube extended forward and extended through said bore of said barrel, said body including a rear portion having a protrusion formed thereon for engaging in said hole of said cap, and said tube including a front portion, and means for securing said barrel to said body and for allowing said barrel and said body and said cap to be assembled together without additional tool, said body including a chamber formed therein and including two pairs of channels formed therein, said body further including two partitions secured in said channels, a stem rotatably engaged in said partitions, at least one gear secured on said stem and located between said partitions, a pair of pawls engaged in said body for engaging with said gear, and a knob having an actuator for engaging with said pawls for controlling an engagement of said pawls with said gear.

* * * * *